US005842955A

United States Patent [19]

Wilkinson

[11] Patent Number: 5,842,955

[45] Date of Patent: Dec. 1, 1998

[54] AEROBIC STEP DEVICE

[76] Inventor: William T. Wilkinson, P.O. Box 73, Salem, N.J. 08079

[21] Appl. No.: 922,237

[22] Filed: Sep. 2, 1997

[51] Int. Cl.[6] ..... A63B 5/00

[52] U.S. Cl. ..... 482/52; 482/51; 206/506

[58] Field of Search ..... 482/51, 52; 248/188.2, 248/911; 108/144; 446/117; 206/505

[56] References Cited

U.S. PATENT DOCUMENTS 5,382,209 1/1995 Pasier et al. ..... 482/52
5,536,072 7/1996 Chany ..... 482/52
5,591,105 1/1997 Dalebout ..... 482/52
5,645,511 7/1997 LeRoux et al. ..... 482/52

*Primary Examiner*—Jerome Donnelly
*Attorney, Agent, or Firm*—Connolly & Hutz

[57] ABSTRACT

An aerobic exercise step device includes a base and two end modules which may be engaged with the base at each end of the base in different positions for providing different elevations. In addition, a central module is provided which may be selectively mounted on top of the base to provide a further height adjustment or may be stored in the base with the feet in the central module being exposed to provide yet another height adjustment. The central module may also function as a separate step.

7 Claims, 2 Drawing Sheets

AEROBIC STEP DEVICE

BACKGROUND OF THE INVENTION

Aerobic steps are a popular form of exercise. For an effective training program, it is desirable to provide adjustability to the height of the steps so as to have the ability to provide a more or less rigorous program. Alternatively, height adjustability is desired for steps sold commercially to home or health club users to accommodate different individual users where height adjustability would be desired to select the proper height in accordance with the need of a particular user. I have disclosed in various of my patents different ways of achieving height adjustability. In that regard, reference is made to my U.S. Pat. Nos. 4,984,785; 5,066,001; 5,069,443; 5,096,186; 5,108,089; 5,116,044; 5,118,096; 5,125,646; 5,127,647; 5,162,028; 5,184,987; 5,248,286; 5,275,579; 5,352,168; 5,354,247; 5,512,026; 5,540,638; and 5,645,510. In addition, reference is made to U.S. Pat. No. 5,158,512.

SUMMARY OF THE INVENTION

An object of this invention is to provide an aerobic step device and method of use which provides varying degrees of height adjustability.

A further object of this invention is to provide such an aerobic step device wherein the components can be stored in a compact condition.

In accordance with this invention the aerobic step device comprises a block like base having a planar upper surface and a lower surface. A pair of end modules are provided with each end module being at one of the ends of the base. Locking structure and complementary locking structure permit the end modules to be selectively engaged with the lower surface of the base to provide height adjustability. In accordance with one aspect of this invention, a central module is also provided which may be stored within a cavity or pocket in the base and which may be engaged with locking structure on the upper surface of the base to provide yet another height adjustability. The central module may itself form a separate step.

THE DRAWINGS

DETAILED DESCRIPTION

Figure 2:
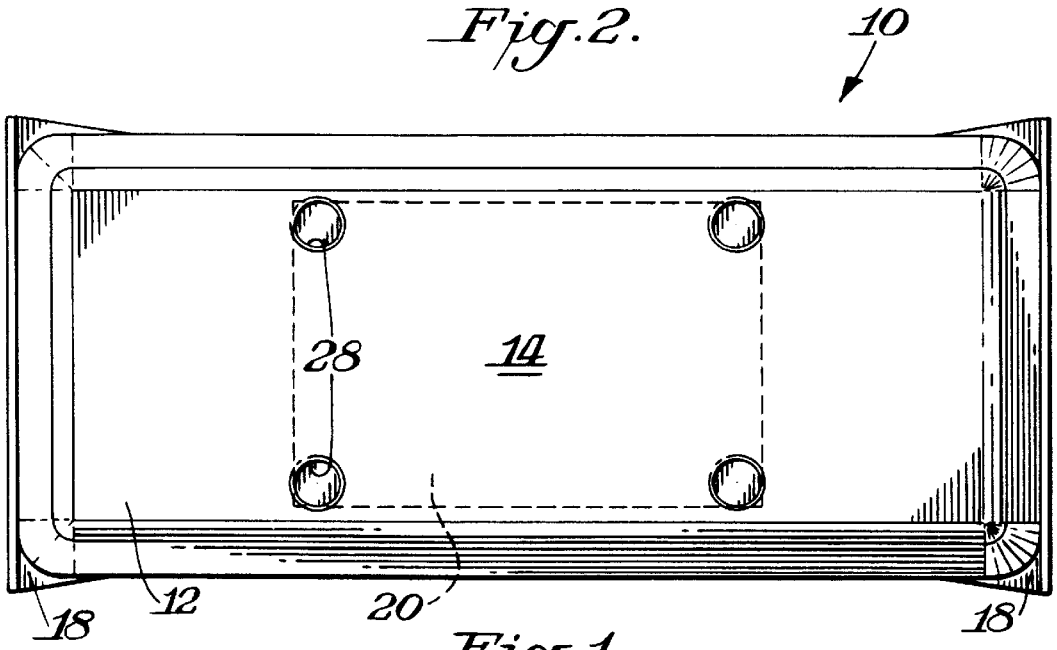
FIG. 2 is a top plan view of the aerobic step device shown in FIG. 1.

The present invention is based upon providing height adjustability to an aerobic step device. In general, in one aspect of the invention the height adjustability is provided by the use of end modules which interlock with the base component so as to provide different height levels for the upper surface or platform of the base component. In another aspect of this invention a central module is provided which when mounted below the base gives height adjustability and which can be mounted on top of the base to give further height adjustability. Preferably, the central module in itself could function as a separate step.

The manner of interlocking the components may be accomplished in various manners. Reference is made to the aforenoted patents and to co-pending application Ser. No. 303,520 filed Sep. 9, 1994, and application Ser. No. 580,048 filed Dec. 20, 1995. All of the details of the aforenoted patents and applications are incorporated herein by reference thereto.

FIGS. 1–4 illustrate an aerobic step device 10 in accordance with this invention. As shown therein the device 10 comprises four basic components. One of the components is a base 12 which is of block like form having a planar upper surface or aerobic stepping platform 14 and a parallel planar lower surface 16. Base 12 includes a pair of opposite ends. Two of the other components are end modules 18 which selectively engage with the lower surface 16 of base 12 in two different orientations to provide two different degrees of height adjustability as later explained. The fourth component is a central module 20 which also provides height adjustability to device 10.

Figure 1:
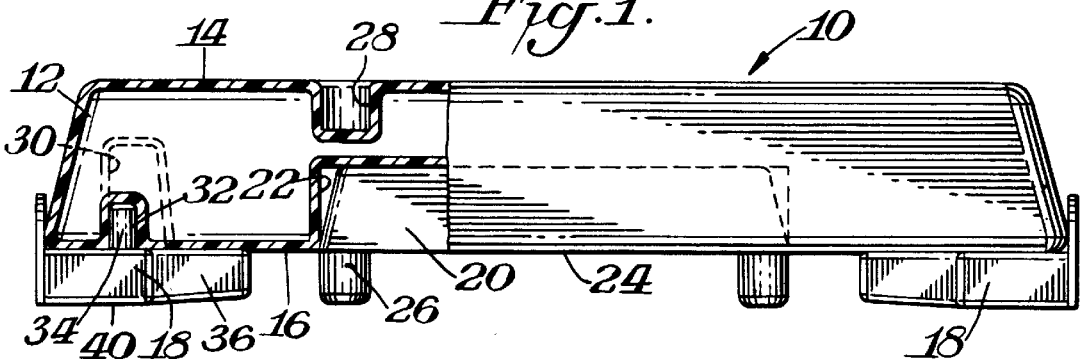
FIG. 1 is a side elevational view partly in section of an aerobic step device in accordance with this invention.
Figure 3:
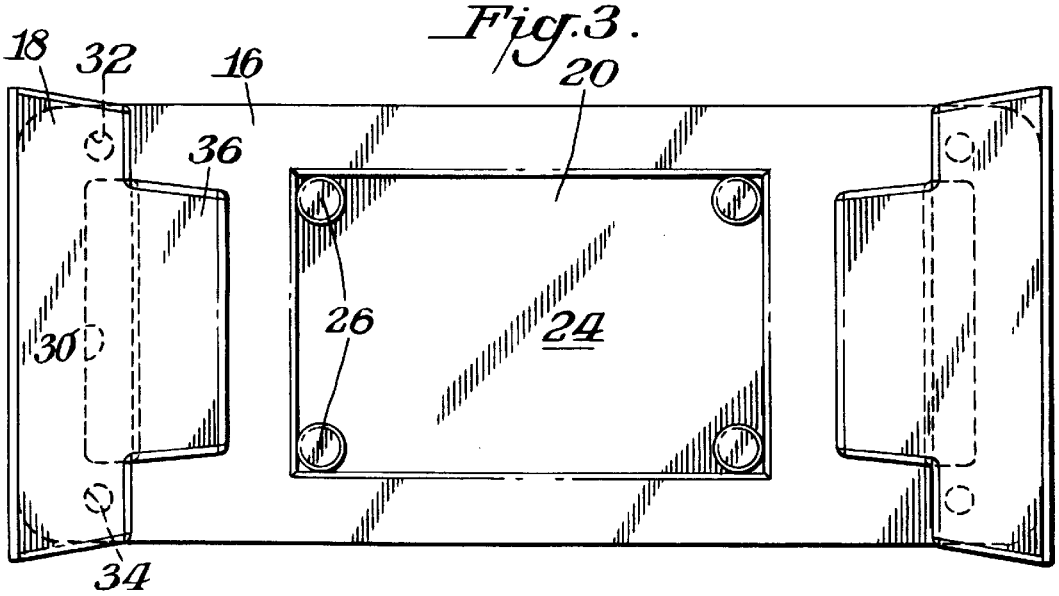
FIG. 3 is a bottom plan view of the device shown in FIGS. 1–2.
Figure 4:
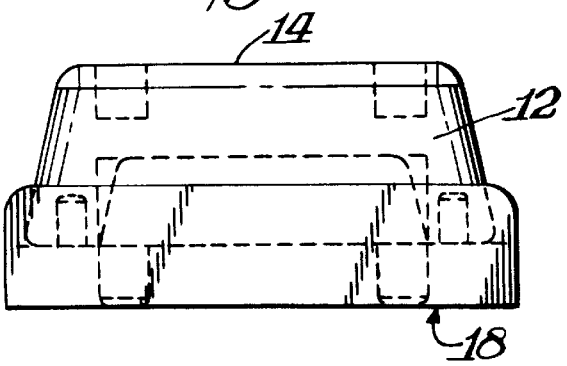
FIG. 4 is a right elevational view of the device shown in FIGS. 1–3.

Base 12 has a centrally located pocket or cavity 22 which is of a size and shape to snugly receive the central module 20. In a preferred practice of this invention the lower surface 24 of central module 20 is generally coplanar with the lower surface 16 of base 12 in the stored condition as shown in FIG. 1. Central module 20, however, includes a plurality, preferably four posts 26 which form legs in each corner that extend outwardly beyond the lower surfaces 16,24.

The upper surface 14 of base 12 includes four holes or depressions or sockets 28 of a size and shape to receive the posts 26 of central module 20. Thus, the holes 28 may be considered as locking structure with posts 26 being complementary locking structure for the selective mounting of central module 20 on base 12.

Figure 5:
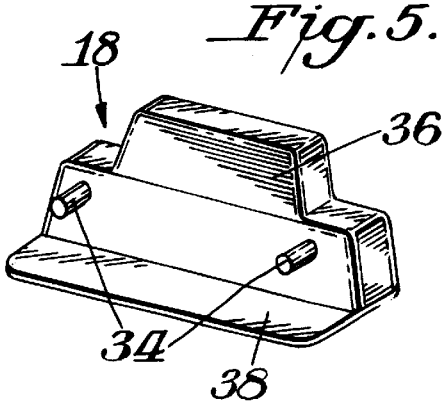
FIG. 5 is a perspective view of an end module used in the device of FIGS. 1–4.

Each end of base 12 includes an elongated slot or recess 30 (see FIGS. 1 and 3) and further includes a pair of holes 32 generally in line with the slot 30. As shown in FIG. 5 end module 18 has a pair of legs or posts 34 which are dimensioned and located to selectively be positioned in holes 32. End module 18 also includes an extension or tongue 36 which is positioned and shaped to fit against the lower surface 16 of base 12 when the posts 34 are in holes 32 as shown in FIG. 1. Alternatively, tongue 36 is positioned and shaped to fit in slot 30 as shown in FIG. 8 where the end modules elevate base 12 a greater distance than the distance elevated by having the posts 34 fit in holes 32 which is the position shown in FIGS. 1 and 7.

Figure 8:
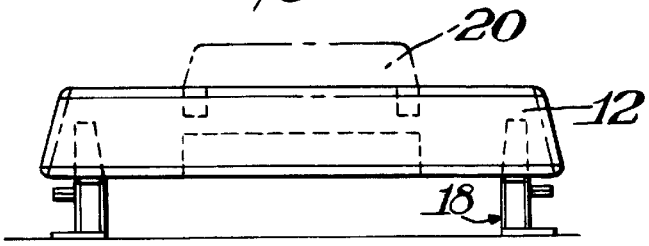

End module 18 also includes a flange or extension 38 which acts as a support when the end module is in the position shown in FIG. 8 to provide stability to the elevated step.

As shown in FIG. 1 posts 26 of central module 20 terminate inwardly of the outer surface 40 of end modules 18. Accordingly, if end modules 18 are removed, posts or legs 26 determine the height elevation of platform 14.

Figure 6:
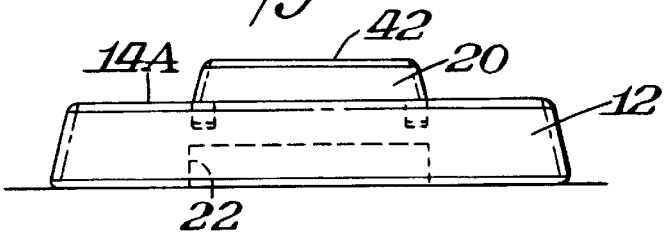
FIGS. 6–8 are side elevational views showing various manners of mounting the components of the device of FIGS. 1–4 for differing height adjustments.
Figure 7:
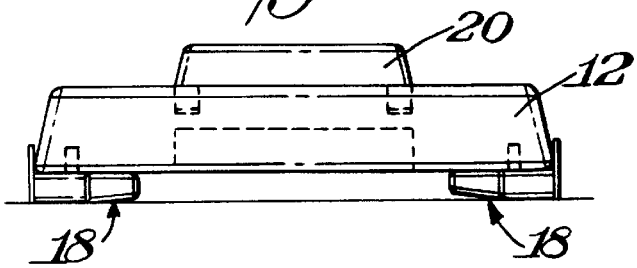

As shown in FIG. 2 and FIGS. 6–7 when central module 14 is mounted on top of base 12 portions of platform 14 remain exposed peripherally around central module 14. In particular, portions 14A extend on each side of base module 20 to provide three platforms, namely 14A,14A and upper planar surface 42 of central module 20. The side portions of platform 14 which are exposed and extend around central module 20 between the end portions 14A,14A may also provide stepping surfaces. Base module 20 itself may comprise a separate step wherein the upper surface 42 would be the stepping platform and wherein the posts 26 would be placed directly on the floor or other support surface.

By utilizing various combinations of locking structures it is possible to achieve a wide variety of height elevations for the step. For example, the engagement of the posts 34 in holes 32 may be considered as first locking and complementary locking structures. The engagement of posts 26 in holes 28 may be considered as a further locking and complementary locking structures and the engagement of tongues 36 in slots 30 may be considered as additional locking and complementary locking structures.

In one practice of this invention the components of device 10 may have the following dimensions. The lower surface 16 of base 12 has a length of 37½ inches and a width of 15¾ inches. Slot 30 is 2½ inches inwardly of the end edge of lower surface 16. Slot 30 has a length of 10 inches and width of about 2 inches with a depth of about 3¾ inches. Each hole 32 is located about 3 inches from its center line to the end edge of lower surface 16 and about 1½ inches inwardly from the side wall with hole 28 having a diameter of about 1 inch. Cavity 22 is located about 10⅜ inches from the end edge of surface 26 and about 2½ inches inwardly from the side edge of surface 26. Cavity 22 has a length of about 16½ inches and a width of about 10¾ inches with a depth of about 3 inches.

Upper platform 14 of base 12 has a length of 34½ inches and a width of 14½ inches. Holes 28 are located about 9½ inches inwardly from the outer end edge of platform 14 to the center line of hole 28 and about 2½ inches inwardly from the side edge. Holes 28 have a diameter of about 1¾ inches. Although the various figures illustrate the posts 26 to have a cylindrical shape with its axis perpendicular to the lower surface 24, posts or legs 26 may be disposed at an angle which follows the angle of the side walls of central module 20. Where legs or posts 26 are thus angularly arranged holes 28 would also have the same angle to snugly receive the posts. The sets of two holes 28 along the side walls are located about 15 inches apart from center line to center line while the aligned holes 28 along each end wall are located about 9 inches apart from center line to center line.

Central module 20 would be dimensioned generally the same as cavity 22 with its posts 26 conforming in size and shape to the holes 28. Thus, for example, the posts 26 would have a height of about 1½ inches and a diameter of about 1½ inches.

Module 18 would have an overall height of about 8 inches from the extension 38 to the outer edge of tongue 36. Tongue 36 would have generally the same shape and dimensions as slot 30. Module 18 would have a length corresponding to the width of lower surface 16 so as to extend completely across the lower surface. The legs 34 would be dimensioned generally the same as holes 32. Extension 40 would be about 4 inches wide.

When central module 20 is mounted on the top of platform 14 the stepping areas 14A would be 8 inches long from the end of central module 20 to the side edge of platform 14 where the platform 14 begins to curve or taper downwardly. Each side stepping area 14A would also have a width of about 13½ inches. The peripheral portions of platform 14 along the longer sides of central module 20 would be about 1 inch wide and about 16 inches long.

The various height adjustments would range from a minimum height for platform 14 to be about 6 inches when no module is connected and lower surface 16 is directly on the floor, to a maximum height of about 14 inches from platform surface 42 to the floor when the components are in the position shown in FIG. 8.

The various possible height achievements would be accomplished as follows. Where end modules 18 and central module 20 are completely removed from base 12, base 12 rests directly on the floor or support surface by means of its planar lower surface 16 which would provide the lowest height adjustability. Where center module 20 is stored in the cavity or pocket 22 with the legs 26 of center module 20 extended, but where the end modules 18 are not included, there is a second higher height adjustability. Where end modules 18 are inserted into holes 32 in the position shown in FIGS. 1 and 7 with surface 40 on the floor (with or without center module 20 being stored in its cavity 22) there is a third height adjustment. Where end modules 18 are inverted 90° so that the tongues 36 are inserted in slots 30, as shown in FIG. 8, there is a further height adjustment. Additional height adjustments are achieved by mounting center module 20 on base 12 when the posts 26 are inserted in holes 28. The additional height adjustments depend upon whether the end modules are used or if the end modules are used whether the end modules are in the position shown in FIG. 7 or the position shown in FIG. 8.

An exercise program can be accomplished by having a separate additional module 20 or the same module 20 of device 10 mounted near the step resulting from the use of base 12 so that a user could step from the upper surface of base 12 to the floor and/or to the upper surface 42 of module 20. Similarly, in the embodiment shown in FIGS. 6–8 an aerobic exercise could be performed by utilizing two or three of the heights available which comprise the floor, the stepping portions 14A of platform 14 and the upper surface of stepping platform 42.

In addition to providing the various height adjustabilities the structure of the invention minimizes storage requirements by permitting the center module to be stored in cavity 22 and also by permitting the end modules to be stored in a compact position shown in FIG. 1 where the posts 34 are inserted in holes 32.

What is claimed is:

1. An aerobic exercise device comprising a platform having a block like base with a planar upper surface and a lower surface, said base having a pair of opposite ends, first locking structure in said lower surface of said base at each of said ends, an end module having first complementary locking structure for selective engagement with said first locking structure for elevating said base, additional locking structure at said lower surface of said base displaced from said first locking surface, and additional complementary locking surface on said end module located generally perpendicular to said first complementary locking surface for selective engagement with said further complementary locking structure for providing an additional height adjustment of said base said first locking structure comprises holes in said lower surface of said base, said first complementary locking structure comprising posts on said end module, said additional locking structure comprising a slot in said base and said additional complementary locking structure comprising a tongue extending from said module, said module further including a wall extending outwardly from said module perpendicular to said tongue to provide a support surface for said base when said tongue is inserted in said slot.

2. The device of claim 1 wherein said further locking structure comprises poles in said upper surface of said base, said further complementary locking structure comprising legs located and shaped to selectively fit in said holes, and said legs providing a support structure whereby said central module may comprise a separate step.

3. The device of claim 2 wherein a portion of said upper surface of said base is exposed on each side of said central module when said further locking structure and said further complementary locking structure are engaged to provide three separate stepping platforms comprising a portion of said upper surface of said base on each side of said central module as two of said platforms and said upper surface of said central module as a third platform.

4. The device of claim 3 wherein an exposed cavity is formed in said lower surface of said base, and said central module fitting in said cavity.

5. The device of claim 4 wherein said posts of said central module extend outwardly from said cavity and terminate at a distance below the outer surface of said end modules when said end modules are engaged with said base whereby said central module posts comprise a support surface for said base when said end modules are disengaged from said base to provide a further height elevation.

6. The device of claim 1 wherein said lower surface of said base is planar and parallel to said upper surface whereby said base has three height adjustments resulting from said lower surface of said base being mounted directly on the floor for a first height adjustment and resulting in the engagement of said posts in said holes for a second height adjustment and resulting in the engagement of said tongue in said slot for a third height adjustment.

7. The device of claim 1 including further locking structure in said upper surface of said base, a central block-like module having a planar upper surface and a lower surface, and further complementary locking structure at said lower surface of said central module for selective engagement to provide an exercise platform above said platform of said base.

* * * * *